US007297670B2

(12) United States Patent
Misra et al.

(10) Patent No.: US 7,297,670 B2
(45) Date of Patent: Nov. 20, 2007

(54) ACIDIC CHEMISTRY FOR POST-CMP CLEANING USING A COMPOSITION COMPRISING MERCAPTOPROPIONIC ACID

(75) Inventors: Ashutosh Misra, Plano, TX (US); Matthew L. Fisher, Allen, TX (US)

(73) Assignee: Air Liquide America L.P., Houston, TX (US)

( * ) Notice: Subject to any disclaimer, the term of this patent is extended or adjusted under 35 U.S.C. 154(b) by 0 days.

(21) Appl. No.: 11/450,843

(22) Filed: Jun. 9, 2006

(65) Prior Publication Data

US 2006/0234888 A1 Oct. 19, 2006

Related U.S. Application Data

(63) Continuation of application No. 10/956,272, filed on Oct. 1, 2004, now Pat. No. 7,087,564.

(60) Provisional application No. 60/550,997, filed on Mar. 5, 2004.

(51) Int. Cl.
*C11D 7/34* (2006.01)
*C11D 7/26* (2006.01)

(52) U.S. Cl. ..... 510/175; 510/258; 510/477; 134/1.2; 134/1.3

(58) Field of Classification Search ..... 510/175, 510/258, 477; 134/1.3, 1.2
See application file for complete search history.

(56) References Cited

U.S. PATENT DOCUMENTS 5,591,270 A * 1/1997 D'Muhala ..... 134/3
6,530,968 B2 * 3/2003 Tsuchiya et al. ..... 51/307
6,585,568 B2 * 7/2003 Tsuchiya et al. ..... 451/36
6,656,924 B1 * 12/2003 Kumemura et al. ..... 514/61
6,806,193 B2 * 10/2004 Korthuis et al. ..... 438/692
6,840,971 B2 * 1/2005 Wang et al. ..... 51/307
7,067,427 B2 * 6/2006 Tsuchiya et al. ..... 438/691
7,087,564 B2 * 8/2006 Misra et al. ..... 510/175
2003/0089891 A1 * 5/2003 Andreas ..... 252/500
2003/0181342 A1 * 9/2003 Seijo et al. ..... 510/175
2005/0076579 A1 * 4/2005 Siddiqui et al. ..... 51/307
2005/0081885 A1 * 4/2005 Zhang et al. ..... 134/2
2005/0090109 A1 * 4/2005 Carter et al. ..... 438/692

* cited by examiner

*Primary Examiner*—Charles Boyer
(74) *Attorney, Agent, or Firm*—Elwood L. Haynes

(57) ABSTRACT

This disclosure discusses cleaning of semiconductor wafers after the Chemical-Mechanical Planarization (CMP) of the wafer during the manufacturing of semiconductor devices. Disclosed is an acidic chemistry for the post-CMP cleaning of wafers containing metal, particularly copper, interconnects. Residual slurry particles, particularly copper or other metal particles, are removed from the wafer surface without significantly etching the metal, leaving deposits on the surface, or imparting significant organic (such as carbon) contamination to the wafer while also protecting the metal from oxidation and corrosion. Additionally, at least one strong chelating agent is present to complex metal ions in solution, facilitating the removal of metal from the dielectric and preventing re-deposition onto the wafer. Using acidic chemistry, it is possible to match the pH of the cleaning solution used after CMP to that of the last slurry used on the wafer surface.

11 Claims, No Drawings

ACIDIC CHEMISTRY FOR POST-CMP CLEANING USING A COMPOSITION COMPRISING MERCAPTOPROPIONIC ACID

CROSS REFERENCE TO RELATED APPLICATIONS

This application is a continuation, of application Ser. No. 10/956,272 filed on Oct. 1, 2004, now U.S. Pat. No. 7,087,564, and for which a Provisional Patent Application was filed on Mar. 5, 2004, having Ser. No. 60/550,997, which is incorporated by reference herein.

BACKGROUND

Manufacturing of electronic wafer chips involves a step wherein semiconductor work-pieces are cleaned with a liquid solution during or after Chemical Mechanical Planarization (CMP). A "semiconductor work-piece" is a microelectronic device, which has not completed the fabrication process, typically a silicon wafer with active regions formed in or on the surface of the silicon wafer. Connections to the active regions are made using multiple layers of metal, typically copper and tungsten, which has been deposited on the silicon substrate. When copper is used as the interconnect material, a damascene process is used whereby the copper is deposited into lines etched into the inter-layer dielectric and then the excess copper is removed and the surface planarized using a CMP process, followed by a cleaning step. The goal of the cleaning process ("Post-CMP cleaning") is to remove residues left by the CMP step from the semiconductor work-piece surface without significantly etching the metal, leaving deposits on the surface, or imparting significant organic (such as carbon) contamination to the semiconductor work-piece. Furthermore, it is desirable to protect the metal surfaces from corrosion by various mechanisms such as chemical etching, galvanic corrosion or photo-induced corrosion. Corrosion of the metal surfaces results in metal recess and thinning of the metal lines. Acidic cleaning solutions are often quite efficient at removing organic contamination from the wafer surface and complexing residual copper. Thus it is desirable have a cleaning solution that is effective in the moderate to low pH regime. Acidic chemistries are typically utilized in a brush scrubber or megasonic cleaning unit for Post-CMP cleaning.

A cleaning solution may contain various chemicals that perform different functions during the cleaning process. A cleaning solution must contain a "cleaning agent." A "cleaning agent" is the component of solution that removes residual CMP slurry particles, typically particles of metal, from the surface of the semiconductor work-piece. A cleaning solution may also contain "chelating agents," "corrosion-inhibiting compounds," and/or "surface-active agents." A "chelating agent" helps prevent re-deposition of removed metal onto the semiconductor work-piece by complexing the metal in the cleaning solution. A "corrosion-inhibiting compound" is the component of the cleaning solution that protects the metal surface from attack by mechanisms such as the aggressive nature of the cleaning solution, oxidation, post cleaning corrosion, galvanic attack, or photo-induced attack. A "surface-active agent" is a component of the cleaning solution that modifies the wetting characteristics and prevents watermark formation.

U.S. Pat. Nos. 6,194,366, 6,200,947, 6,436,302, 6,492,308, 6,546,939, 6,673,757 and U.S. Patent Publication 2001/0004633 disclose information relevant to Post-CMP cleaning solutions. However, these references suffer from one or more of the disadvantages discussed below.

The optimum cleaning solution should protect the metal surfaces of the semiconductor device from having a high static etch rate and from oxidation of the metal surfaces by forming a protective film on the surface. The metal surfaces of the semiconductor work-piece are typically copper, and form the conducting paths of the semiconductor wafer. Due to the very small size of features on semiconductor wafers, the metal lines are as thin as possible while still carrying the desired electric current. Any oxidation or corrosion on the surface or recess of the metal causes thinning of the lines (dissolution) and results in poor performance or failure of the semiconductor device. Therefore, it is important to protect the metal surfaces from corrosion by forming a suitable corrosion resistant film on the surface of the metal. Some cleaning solutions available in the art do not provide a film forming agent, and thus suffer from a high static etch rate and/or high RMS value.

The cleaning solution's corrosion preventing abilities are quantified by measuring the static etch rate or the surface roughness (quantified by RMS, root mean square, value) of a metal surface that has been cleaned with the subject solution. A high static etch rate indicates dissolution of the metal surface is occurring. A high RMS value indicates a rough surface caused by attack of the metal. An effective protective film reduces the corrosion of the metal as indicated by static etch rate and RMS values after cleaning. The corrosion resistance of a cleaning solution can also be directly measured using electrochemical means known to those skilled in the art.

One preferred method of protecting the metal surface from oxidation corrosion is by passivating the metal surface after or during cleaning. Some existing acidic cleaning chemistries do not passivate the metal, resulting in corrosion during and after the cleaning step by oxidation of the metal surface.

It is also desirable to clean and protect the semiconductor surface in a single step. Some chemistries for planarizing a wafer surface include a cleaning step followed by an additional step of rinsing with water or an inhibitor solution. Some rinsing agents can leave deposits on the surface of the work-piece, thus contaminating the wafer. Adding a second step is also a drawback due to the fact that it lengthens the manufacturing process, complicates the process by having to handle more chemicals and more steps, and provides one more possible source of contamination or other quality control problems. Clearly, a process that cleans and protects the surface of the semiconductor work-piece is desirable.

The ability of the cleaning chemistry to remove residual metals and retain them in the cleaning solution is also an important characteristic of a Post-CMP cleaning solution. Chemicals that can complex the residual metals in the cleaning solution are effective cleaning solutions because the residual metals are not re-deposited on the semiconductor work-piece after they are removed. These complexing chemicals are referred to as "chelating agents." Cleaning solutions using chemistry that cannot complex the residual metals typically perform poorly at the desired cleaning task. Thus, it is desirable to have a cleaning solution capable of removing and complexing the dissolved metal in the cleaning solution.

Another common problem with cleaning semiconductor surfaces is the deposition of contaminants on the surface of the semiconductor device. Any cleaning solutions that deposit even a few molecules of undesirable composition, such as carbon, will adversely affect the performance of the semiconductor device. Cleaning solutions that require a rinsing step can also result in depositing contaminants on the surface. Thus, it is desirable to use a cleaning chemistry that is will not leave any residue on the semiconductor surface.

It may also be desirable to have a surface wetting agent in the cleaning solution. Surface wetting agents prevent contamination of the semiconductor work-piece by helping to stop spotting of the surface caused by droplets clinging to the surface. Spotting (also called watermarks) on the surface can saturate metrology tools that measure light point defects, thus masking defects in the semiconductor work-piece.

As indicated above, the available cleaning solutions do not adequately meet all of the requirements of post-CMP cleaning. The chemistry of the current invention makes use of multiple additives to provide a solution that is not sensitive to oxygen, removes particles efficiently, removes metal from the dielectric surface, is in the neutral to low pH range, protects the metal from corrosion and dissolution, and does not contaminate the semi conductor surface.

SUMMARY

The current invention provides a solution for cleaning a semiconductor work-piece that is not sensitive to oxygen, removes residual particles efficiently, removes metal, particularly copper, from the dielectric surface, is in the neutral to low pH range, protects the metal from oxidation, corrosion and dissolution, and does not contaminate the semiconductor surface. Furthermore, cleaning and protecting the metal surfaces are completed in a single step with a single solution.

The cleaning solution of the current invention comprises a cleaning agent and a corrosion-inhibiting compound. The cleaning agent is either ammonium citrate, ammonium oxalate, aspartic acid, benzoic acid, citric acid, cysteine, glycine, gluconic acid, glutamic acid, histidine, maleic acid, oxalic acid, propionic acid, salicylic acid, or tartaric acid, or combinations of more than one of these cleaning agents. The corrosion-inhibiting compound is either ascorbic acidbenzotriazole, caffeic acid, cinnamic acid, cysteine, glucose, imidazole, mercaptothiazoline, mercaptoethanol, mercaptopropionic acid, mercaptobenzothiazole, mercaptomethylimidazole, tannic acid, thioglycerol, thiosalicylic acid, triazole, vanillin, or vanillic acid, or combinations of more than one of these corrosion-inhibiting compounds.

The cleaning agents of the current invention are also chelating agents. The cleaning action of the current invention efficiently removes residual particles from the surface of the semiconductor work-piece and also complexes the metal that is removed in solution. Thus the cleaning efficiency is improved by preventing metal from re-depositing on the semiconductor work-piece surface.

The corrosion-inhibiting compound of the current invention protects the metal of the semiconductor work-piece from oxidation, and corrosion. The corrosion-inhibiting compounds are effective at forming a film on the metal of the semiconductor work-piece that protects metal surfaces from chemical, galvanic and photo-induced attack during and after the cleaning step. One preferred embodiment forms a protective film by reducing the surface of the metal. By protecting the metal surface from attack, the metal retains its desired thickness and electrical carrying capacity.

The cleaning solution of the current invention is not highly sensitive to oxygen because it does not contain any oxygen sensitive compounds. Because the cleaning solution is not highly sensitive to oxygen, the performance of the cleaning solution is not affected by the presence of air in the cleaning equipment. Thus, the cleaning solution of the current invention can be used without extra precautions to purge the storage, transfer and cleaning equipment of essentially all air.

The cleaning solution of the current invention cleans the semiconductor work-piece and forms a corrosion-inhibiting film on the metal surfaces in the same step. Because the cleaning and corrosion inhibiting is accomplished in a single step, there is less likelihood of accidental contamination by handling a completely separate solution. Furthermore, valuable processing time is saved by not having to add an additional inhibiting step.

Some preferred embodiments of the cleaning solution include a surface-active agent, also referred to as a surface-wetting agent. The surface-active agent helps prevent spotting (watermarks) on the surface that can be a source of contamination or hide defects in the semiconductor work-piece.

DESCRIPTION

The present invention is a cleaning solution for cleaning a semiconductor work-piece. The composition of the cleaning solution comprises a cleaning agent and a corrosion-inhibiting compound. Preferred cleaning agents are ammonium citrate, ammonium oxalate, aspartic acid, benzoic acid, citric acid, cysteine, glycine, gluconic acid, glutamic acid, histidine, maleic acid, oxalic acid, propionic acid, salicylic acid, tartaric acid, or mixtures thereof. Preferred corrosion-inhibiting compounds are ascorbic acid, benzotriazole, caffeic acid, cinnamic acid, cysteine, glucose, imidazole, mercaptothiazoline, mercaptoethanol, mercaptopropionic acid, mercaptobenzothiazole, mercaptomethylimidazole, tannic acid, thioglycerol, thiosalicylic acid, triazole, vanillin, vanillic acid, or mixtures thereof.

Preferred cleaning solutions may contain mixtures of more than one cleaning agent. Furthermore, preferred cleaning agents may perform more than one function. For example, one preferred cleaning agent, cysteine, complexes residual metals in the solution, and passivates the metal surface.

Preferred embodiments may contain mixtures of more than one corrosion-inhibiting compound. For example one preferred cleaning solution comprises ammonium citrate, the cleaning agent, and a mixture of ascorbic acid and cysteine, the corrosion-inhibiting compounds. In this embodiment, a preferred mixture has concentrations of 5 wt. % ammonium citrate, 0.5 wt. % ascorbic acid and 0.5 wt. % cysteine. The preferred embodiment can be diluted 5× to 20× with de-ionized (DI) water prior to use. Another preferred cleaning solution comprises ammonium citrate and a mixture of ascorbic acid and mercaptopropionic acid.

Preferred embodiments of a cleaning solution of the current invention have a neutral to acidic pH. Even more preferred is a pH of about 2 to about 6.

The cleaning solution may be supplied in concentrated form, or diluted with water or other suitable diluents known to one skilled in the art.

One preferred cleaning solution includes a surface-active agent to promote even wetting of the semiconductor surface. Preferred embodiments include, but are not limited to, non-ionic, anionic, cationic, zwitterionic or amphoteric surfactants or mixtures thereof.

One skilled in the art can produce the cleaning solutions of the current invention using conventional chemical mixing techniques without undue experimentation.

EXAMPLES

The present invention is illustrated in more detail with reference to the following Examples, which are for illustrative purposes and should not be construed as limiting the scope of the present invention.

Example 1

Chemicals of the present invention were tested to determine the particle removal efficiency compared to commercially available acidic post-CMP cleaners. Blanket copper wafers were contaminated with a commercially available Barrier CMP slurry comprised of silica particles. The wafers were then cleaned with samples of the chemicals of the present invention in a megasonic tank followed by rinsing and spin rinse drying. A control wafer that was not exposed to any slurry particles, as well as a contaminated wafer that was only cleaned with DI water were included in the study for comparison. The results shown in Table 1 demonstrate the effectiveness of one embodiment of the present invention at removal of residual slurry particles from the copper surface as compared to a commercially available alternative. The particle counts on the wafer cleaned with the chemistry of the present invention measured by a standard KLA-Tencor SP1 recipe were close to those of the uncontaminated wafer and lower than the wafer cleaned with the commercial acidic post-CMP clean.

TABLE 1

Table 1: SP1 particle removal data for Cu wafers exposed to silica particle slurries and cleaned with DI water, a commercially available product and a preferred embodiment of the present invention.

| | Defect Totals | |
|---|---|---|
| Cleaning Chemistry | All [#] | Lpd [#] |
| Control Wafer | 742 | 706 |
| DI Water Clean | 65431 | 65402 |
| Commercial Chemistry | 1852 | 1368 |
| Citric + Ascorbic + Cysteine | 1457 | 1451 |

"All" means the total of all defects.
"Lpd" means light point defects.
"[#]" means number.

Example 2

In a second study, patterned Cu/low k and blanket copper wafers were exposed to chemicals of the present invention as well as commercially available alternatives, in order to determine the efficiency of chemicals in protecting copper and barrier materials from corrosion and dissolution. Table 2 shows one set of data from these experiments, illustrating that a preferred embodiment of the present invention is much more effective at preventing barrier dissolution (example of prevention of galvanic corrosion) than a commercially available acidic post-CMP cleaner. The data also suggest that this chemical is also more protective of the copper against corrosion, and yet is still capable of cleaning the particles from the surface more efficiently as evidenced by Example 1.

TABLE 2

Table 2: Copper and barrier dissolution numbers for patterned wafers exposed to a commercially available product and a preferred embodiment of the present invention. The preferred embodiment is capable of protecting the barrier material from galvanic corrosion.

| Cleaning Chemistry | Cu (ppb) | Barrier (ppb) |
|---|---|---|
| Citric + Ascorbic + Cysteine | 20.2 | <0.5 |
| Commercial Chemistry | 41 | 34 |

Although the present invention has been described in considerable detail with reference to certain preferred versions thereof, other versions are possible. For example, the composition may be practiced in a process other than post-CMP cleaning. In addition, the cleaning of semiconductor work-pieces can be accomplished at a variety of concentrations of cleaning solution, temperature and conditions. Furthermore, the invention may be used to clean a variety of surfaces, including but not limited to surfaces containing copper, silicon, and dielectric films. Therefore, the spirit and scope of the appended claims should not be limited to the description of one preferred versions contained herein. The intention of the applicants is to cover all modifications, equivalents, and alternatives falling within the spirit and scope of the invention as defined by the appended claims.

What is claimed is:

1. A post CMP cleaning composition for cleaning a semiconductor work-piece after at least one CMP manufacturing step, the composition comprising:

(a) a cleaning agent, wherein said cleaning agent is selected from the group consisting of ammonium oxalate, aspartic acid, benzoic acid, citric acid, cysteine, qlycine, gluconic acid, glutamic acid, histidine, maleic acid, oxalic acid, propionic acid, salicylic acid, tartaric acid, and mixtures thereof;

(b) a corrosion-inhibiting compound, wherein said corrosion-inhibiting compound is selected from the group consisting of caffeic acid, glucose, imidazole, mercaptothiazoline, mercaptoethanol, mercaptobenzothiazole, mercaptomethylimidazole, tanic acid, thiosalicylic acid, triazole, and mixtures thereof; and (c) mercaptopropionic acid.

2. The composition of claim 1, further comprising a surface-active agent.

3. The composition of claim 2, wherein said surface-active agent is selected from the group consisting of:

(a) non-ionic;

(b) anionic;

(c) cationic;

(d) zwitterionic;

(e) amphoteric surfactants;

(f) and mixtures thereof.

4. The composition of claim 1, further comprising a diluent.

5. The composition of claim 1, wherein the pH is between about 2 to about 6.

6. A method for the cleaning of a semiconductor work-piece after at least one CMP manufacturing step, the method comprising the steps of:

(a) providing a semiconductor work-piece;

(b) contacting said semiconductor work-piece with a cleaning solution after at least one CMP manufacturing step, said solution comprising:

(1) a cleaning agent, wherein said cleaning agent is selected from the group consisting of ammonium oxalate, aspartic acid, benzoic acid, citric acid, cysteine, qlycine, gluconic acid, glutamic acid, histidine, maleic acid, oxalic acid, propionic acid, salicylic acid, tartaric acid, and mixtures thereof;

(2) a corrosion-inhibiting compound, wherein said corrosion-inhibiting compound is selected from the group consisting of caffeic acid, glucose, imidazole, mercaptothiazoline, mercaptoethanol, mercaptobenzothiazole, mercaptomethylimidazole, tanic acid, thiosalicylic acid, triazole, and mixtures thereof; and (3) mercaptopropionic acid.

7. The method of claim 6, wherein said cleaning solution further comprises a surface-active agent selected from the group consisting of:

(a) non-ionic;

(b) anionic;

(c) cationic;

(d) zwitterionic; and (e) amphoteric surfactants;

(f) and mixtures thereof.

8. The method of claim 6, wherein said cleaning solution further comprises a diluent.

9. The method of claim 6, wherein said semiconductor work-piece comprises:

(a) a metal line;

(b) a barrier material; and (c) a dielectric.

10. The method of claim 9, wherein said metal line comprises copper.

11. The method of claim 10, wherein said barrier material comprises materials selected from the group consisting of:

(a) Ta, (b) TaN, (c) Ti, (d) TIN, (e) W, and (f) WN.

* * * * *

UNITED STATES PATENT AND TRADEMARK OFFICE

CERTIFICATE OF CORRECTION

PATENT NO. : 7,297,670 B2
APPLICATION NO. : 11/450843
DATED : November 20, 2007
INVENTOR(S) : Ashutosh Misra and Matthew L. Fisher It is certified that error appears in the above-identified patent and that said Letters Patent is hereby corrected as shown below:

In Column 6, line 61, replace the words "claim 1" with the words --claim 3--

In Column 8, line 18, replace the word "TIN" with the word --TiN--

Signed and Sealed this
Ninth Day of August, 2011

David J. Kappos

David J. Kappos
*Director of the United States Patent and Trademark Office*